US006793568B2

(12) United States Patent
Dotta

(10) Patent No.: US 6,793,568 B2
(45) Date of Patent: Sep. 21, 2004

(54) HANDLE FOR AN ORBITAL SANDER

(75) Inventor: Allan John Dotta, Springwood (AU)

(73) Assignee: Super Sander Solutions Pty Ltd, Queensland (AU)

( * ) Notice: Subject to any disclaimer, the term of this patent is extended or adjusted under 35 U.S.C. 154(b) by 0 days.

(21) Appl. No.: 10/312,639

(22) PCT Filed: May 24, 2001

(86) PCT No.: PCT/AU01/00619

§ 371 (c)(1),
(2), (4) Date: Dec. 3, 2002

(87) PCT Pub. No.: WO01/94080

PCT Pub. Date: Dec. 13, 2001

(65) Prior Publication Data

US 2003/0096565 A1 May 22, 2003

(30) Foreign Application Priority Data

Jun. 6, 2000 (AU) ..... 37930/00
Aug. 9, 2000 (AU) ..... 51928/00

(51) Int. Cl.[7] ..... B24B 23/04
(52) U.S. Cl. ..... 451/357; 451/442; 451/456
(58) Field of Search ..... 451/344, 354, 451/356, 357, 359, 441, 391, 442, 451, 456; 16/110.1, 421, 422, 426, 430

(56) References Cited

U.S. PATENT DOCUMENTS 3,826,045 A * 7/1974 Champayne ..... 451/359
5,993,305 A * 11/1999 Chu ..... 451/357
6,053,805 A 4/2000 Sanchez
6,413,157 B1 * 7/2002 Marton ..... 451/357
6,558,235 B2 * 5/2003 Berg et al. ..... 451/41
6,722,967 B1 * 4/2004 Oddo et al. ..... 451/353

FOREIGN PATENT DOCUMENTS

| | | | |
|---|---|---|---|
| AU | 199920348 | 8/1999 | |
| DE | 40 32 069 | 9/1991 | |
| EP | 727281 A1 * | 8/1996 | ..... B24B/23/02 |
| JP | 08252757 A * | 10/1996 | ..... B24B/23/00 |
| WO | 00/06343 | 2/2000 | |

* cited by examiner

*Primary Examiner*—Joseph J. Hail, III
*Assistant Examiner*—David B. Thomas
(74) *Attorney, Agent, or Firm*—Renner, Otto, Boisselle & Sklar, LLP

(57) ABSTRACT

A handle for an orbital sander (10) of the type having a dust extractor (17) containing an exhaust outlet (18), the handle having: a first part in the form of an elongate tubular member (19) having two open ends, one end being attachable to the exhaust outlet (18) to attach the handle to the sander and to allow dust to pass through the first tubular member, the other end being attachable to a dust discharge hose (22), a second part which is extendable over the top of the sander, attachment means (28) to allow the handle (33) to be attached to a pole, and, guide means (34) extending from a portion of the handle spaced from the guide means being adapted to contact the surface to be sanded and functioning to hold the handle (33) relative to the surface such that, when attached to the sander, the sander is in working alignment with the surface.

14 Claims, 6 Drawing Sheets

HANDLE FOR AN ORBITAL SANDER

FIELD OF THE INVENTION

This invention relates to a handle which can be attached in a particular manner to an orbital sander to allow the sander to be used on walls, ceilings, and the like.

The invention will be described with use of the sander and the handle in the field of plastering, but it should be appreciated that no limitation is meant thereby.

BACKGROUND ART

In the plastering profession, wall boards, ceiling boards, cornices, and the like are joined in an invisible manner by the use of plaster. The plaster is applied in several coats and must be sanded down between coats. Sanding is extremely time consuming but great care must be taken in order to ensure a smooth and acceptable finish. Ceilings and ceiling corners need to be sanded as well as walls and this requires the use of ladders, scaffolding or even stilts, all of which are time consuming, clumsy and present an element of danger. Orbital sanders are conventionally used to sand down between coats. For ceilings, the sanders must be held in an upside-down orientation for quite a lengthy time. Similarly, when sanding wall joins, the sander must be held in a vertical position and must often be held above the person's head. Attempts have been made to hold the orbital sander in some form of cage or housing. The cage or housing can then be attached to an extension pole. However, the cage or housing tends to be quite heavy and is attached at various points to the sander. Often, holes need to be drilled through the sander body or even sander head which can nullify any warranty to the sander and can also present an electrical shock risk.

OBJECT OF THE INVENTION

The present invention is directed to a handle of special design which can be attached to an orbital sander in a particular manner and can function to at least partially reduce the abovementioned disadvantages or provide the public with a useful or commercial choice.

In one form, the invention resides in a handle for an orbital sander of the type having a dust extractor containing an exhaust outlet, the handle having:

a first part in the form of an elongate member having a through passageway with two open ends, one end being attachable to the exhaust outlet to attach the handle to the sander and to allow dust to pass through the first passageway member, the other end being attachable to a dust discharge hose, a second part which is extendable over the top, or at least partially over a portion of the sander, and attachment means to allow the handle to be attached to a pole. Suitably, the first part is an elongate tubular member.

The handle may include guide means extending from a portion of the handle spaced from the sander, the guide means being adapted to contact the surface to be sanded and functioning to hold the handle relative to the surface such that, when attached to the sander, the sander is in working alignment with the surface.

In a more particular form, the handle as described above, is attached to the sander only about the exhaust outlet.

In another form, the invention resides in a handle for an orbital sander, the handle being attachable to the sander and having guide means adapted for engagement with the surface to be worked.

The handle has a first part which can comprise a hollow cylindrical tube which can be formed of metal or plastic. The tube is typically straight and has two opposed open ends. One end is attached to the exhaust outlet in such a manner that the dust can pass through the tubular member. If the exhaust outlet is provided with a collar, the tubular member can be fitted about the collar. If necessary, a coupling or other form of attachment means may be required to allow the tubular member to be attached in such a manner that the exhaust dust passes through the tubular member. The length of the tubular member can vary to suit but a typical length will be between 20–40 cm. The tubular member can have various diameters, or various cross-sections If the tubular member is not circular; It is typical for the diameter to be between 10–30 mm to provide a good flow through of dust. The other end of the tubular member can be attached to a dust discharge hose. For instance, this can be in the form of a vacuum hose to suck the dust through the tubular member to a dust bag. The tubular member need not be attached to a vacuum hose in which case the dust will simply pass out the other open end, but if the tubular member is of sufficient length, this will be away from the person's face.

The handle has a second part. The second part may also comprise a tubular member and may be of a length and diameter similar to that above. The second part has a portion which extends over the top, or over part of the sander, for instance, the handle of the sander. It is preferred that the second part does not extend past the top of the sander as if it does so, it may damage or scratch an adjacent wall. An attachment means is provided to allow the handle to be attached to a pole. This allows a person to sand the ceiling while standing on the ground. The attachment means may be in the form of an attachment plate, bracket, collar, and the like. It is preferred that the attachment means is on the second part. It is further preferred that the attachment means is on the second part and generally over the top of the sander, or at a "balance point" of the sander, as this allows an attached pole to properly hold the weight of the handle and the sander.

The handle may have a guide means. The guide means extends from a portion of the handle spaced from the sander and typically is attached to or extends from a rear portion of the first part. The guide means functions to hold the handle at a position such that the sander face is flat on the wall of ceiling to be worked. The guide means can be in the form of one or more slide members which can slide over the surface to be sanded. The slide members may be in the form of rearwardly extending fingers. Other forms of guide means are envisaged. For instance, the guide means comprise one or more rollers which may be castor rollers to allow the rollers to swivel. Alternatively, the guide means may be in the form of a simple knob which may be formed of or coated with a low friction material such as Teflon to facilitate sliding over the surface to be sanded. The guide means may be removable from the handle if not required.

It is preferred that a safety guard is provided to protect the sanding pad. The safety guard may comprise a collar which can be fitted about the sander and which functions to prevent the sander pad from striking an adjacent wall.

To improve the versatility of the handle, it is preferred that the guard is attachable to the exhaust outlet and/or the first part of the handle as this eliminates the need to drill holes into any part of the orbital sander itself in which to mount the safety guard.

BRIEF DESCRIPTION OF THE DRAWINGS

An embodiment of the invention will be described with reference to the following drawings in which.

BEST MODE

Figure 1:
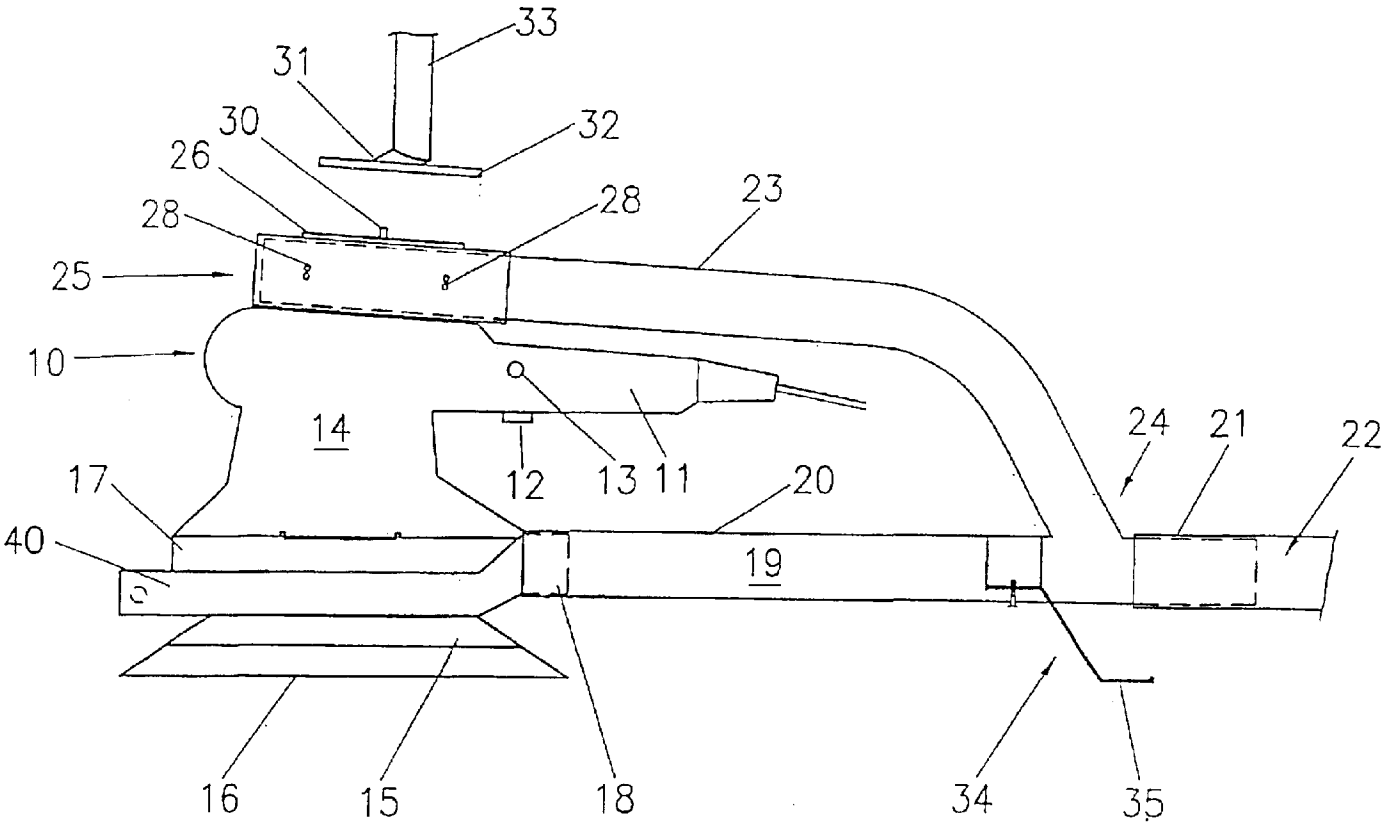
FIG. 1 is a side view of a handle attached to an orbital sander, the sander being commercially available.

Referring to the drawings and initially to FIG. 1, there is illustrated a handle which is attached to an orbital sander. The orbital sander 10 is available commercially in the marketplace and comprises a rear handle 11, an on-off trigger 12, a trigger lock button 13, a main plastic body 14 which houses the sander motor, a lower rotating sanding face 15 on which a sanding pad 16 is attached. In the embodiment, sander 10 is fitted with a known dust extracting unit 17 which extracts dust and passes it through an exhaust outlet 18.

Attached to sander 10 is the handle which forms part of the invention. The handle has a first part which is In the form of a straight cylindrical hollow tube 19. Tube 19 has two open ends 20, 21. In the embodiment, tube 19 has a diameter such that the tube can be press fitted over outlet 18. If required, a clamp can be attached to firmly hold tube 19 to the outlet. Of course, other types of attachments can be used such as brackets and the like depending on the shape of the exhaust outlet 18. Tube 19 has a diameter of 20 mm and a length of about 25 cm. This can of course vary to suit. Rear end 21 of tube 19 is open and an exhaust hose such as a vacuum hose 22 can be clamped or otherwise attached to the rear end 21 to exhaust any dust passing from the sander.

The handle contains a second part which is in the form of an elongate shaped tube 23. Tube 23 has two ends being a rear end 24 and a front end 25. Rear end 24 is rigidly attached to the rear portion of tube 19 to hold the two parts firmly with respect to each other. Tube 23 is shaped such that it overlies the top of body 14 but is not attached to the body by any fasteners. If desired, tube 23 can be shaped to touch or abut against the top of the sander. The length of tube 23 is such that forward end 25 is spaced inwardly with respect to a leading edge of the sander such that forward end 25 will not strike an adjacent wall and cause damage to it.

Figure 2:
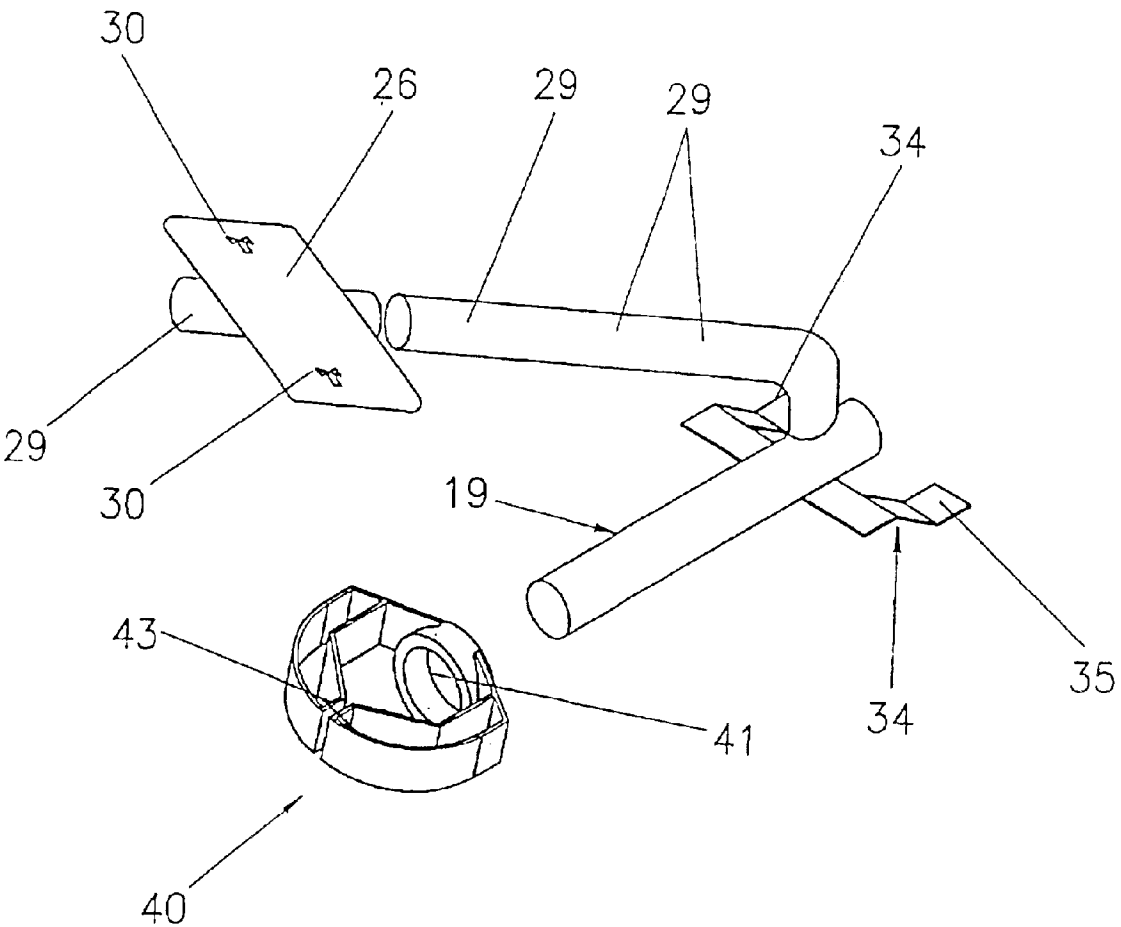
FIG. 2 is a isometric view of the various parts of the handle and illustrating a safety guard.

An attachment means is provided to allow the handle to be attached to a pole. In the embodiment, the attachment means is in the form of a plate 26 which extends transversely over an upper part of tube 19. This is better illustrated with respect to FIG. 2. Plate 26 is attached to a sleeve or collar 27. The sleeve or collar being slidable over the end of tube 23. Collar 27 can be clamped to tube 23 via fasteners in the form of wing nuts 28. In FIG. 2, a number of fastening apertures 29 are provided to provide adjustability to the position of collar 27 and therefore plate 26. Plate 26 has two spaced apart outwardly extending threaded bolts 30. The bolts pass through corresponding openings 31 in a plate 32, the plate being pivotally attached to an extension pole or handle 33. In this manner, the extension pole 33 can be readily attached to the handle which forms part of the present invention. The pole 33 and its pivoting plate 32 is well-known in the marketplace and these poles are available commercially.

The handle has a guide means. The guide means in the embodiment is in the form of a pair of trailing flat fingers 34. Fingers 34 are attached to tube 19 at a position distant from sander 10. Fingers 34 are sized and shaped such that they present a rearmost flat portion 35 which is adapted to abut against and slide against a wall to be sanded. Portion 35 is spaced from tube 19 by a distance which is substantially the same as the distance between pad 16 and tube 19, Thus, when the handle is attached to the sander, the handle can be pressed against the wall or ceiling such that portions 35 ride along the wall of ceiling which ensures that pad 16 is also in a working alignment and will not gouge into the surface to be worked.

A safety guard 40 is fitted about sander 10 and functions to prevent pad 16 from striking an adjacent wall which can damage the pad but can also cause damage to the wall. Guard 40 comprises a buffer or barrier which, when viewed In plan, extends proud of the edges of the pad in a forward area to minimise or prevent the pad from striking an adjacent wall. In the embodiment, guard 40 is attached to exhaust outlet 18 which does away with any need for drilling holes into the sander itself.

Referring to FIG. 2, guard 40 is in the form of a shaped strap which has a rear annular collar 41 to allow it to fit to exhaust outlet 18 and/or over or against end 20 of tube 19. A forward portion of guard 40 has an adjustment and locking mechanism which comprises a nut and bolt 43 which can be loosened or tightened to loosen or tighten the guard about the lower part of sander 10.

Figure 3:
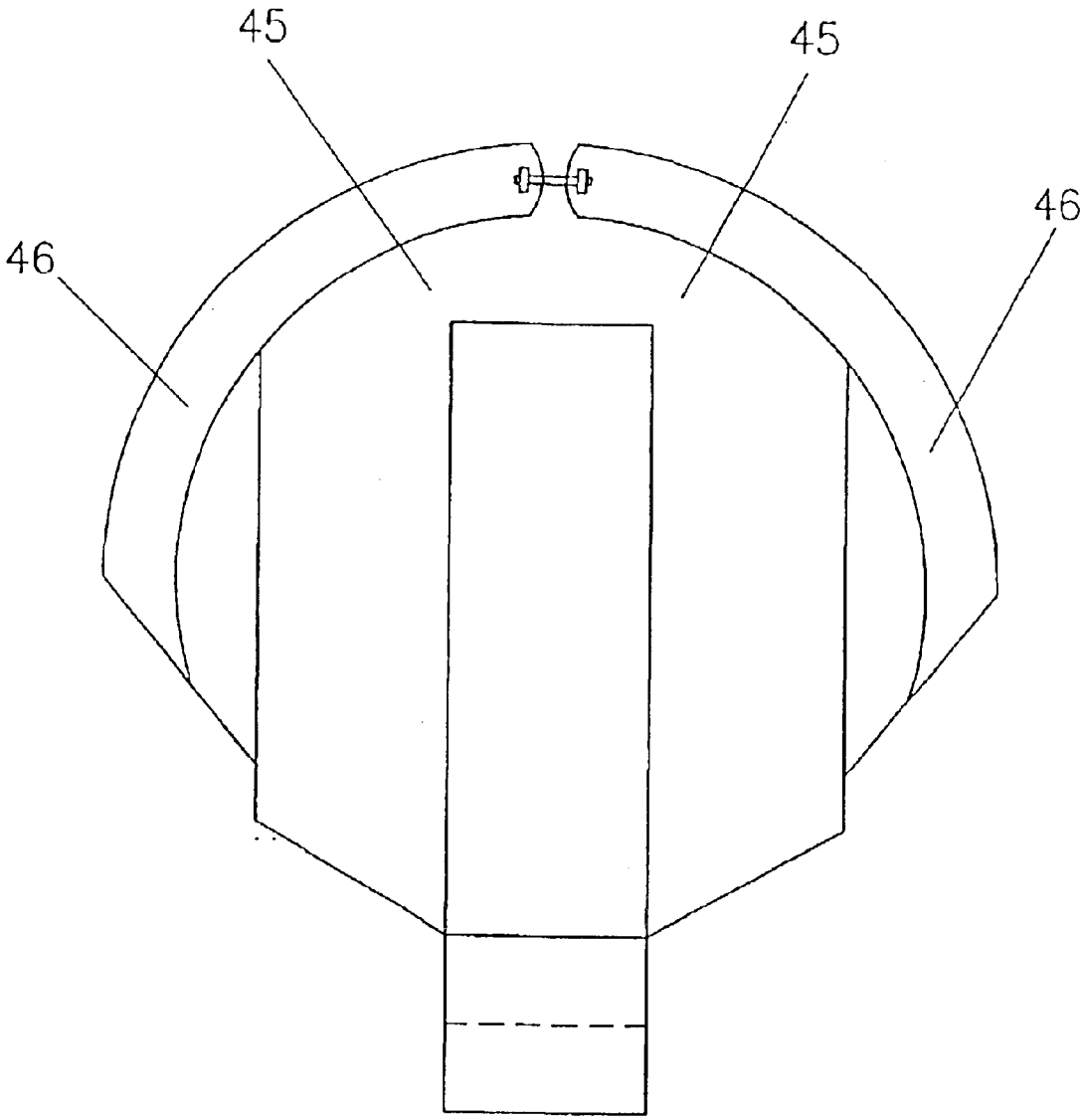
FIG. 3 is a plan view of a safety guard according to an embodiment of the invention.

In FIG. 3, there Is better illustrated how the forward part 45 of the guard extends in front of the outer edge 46 of sanding pad 16.

Figure 4:
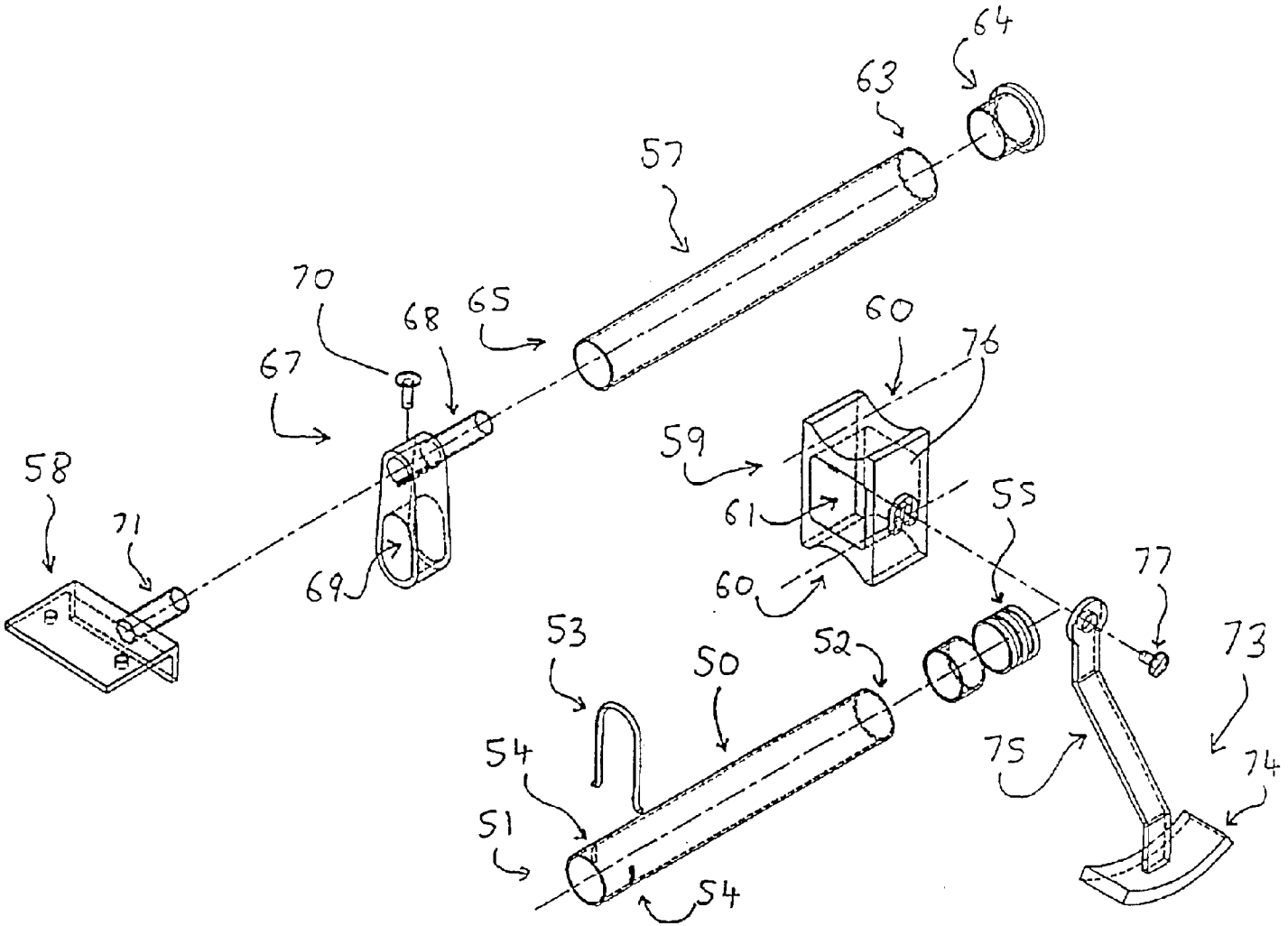
FIG. 4 is an exploded view of a slightly different handle.
Figure 5:
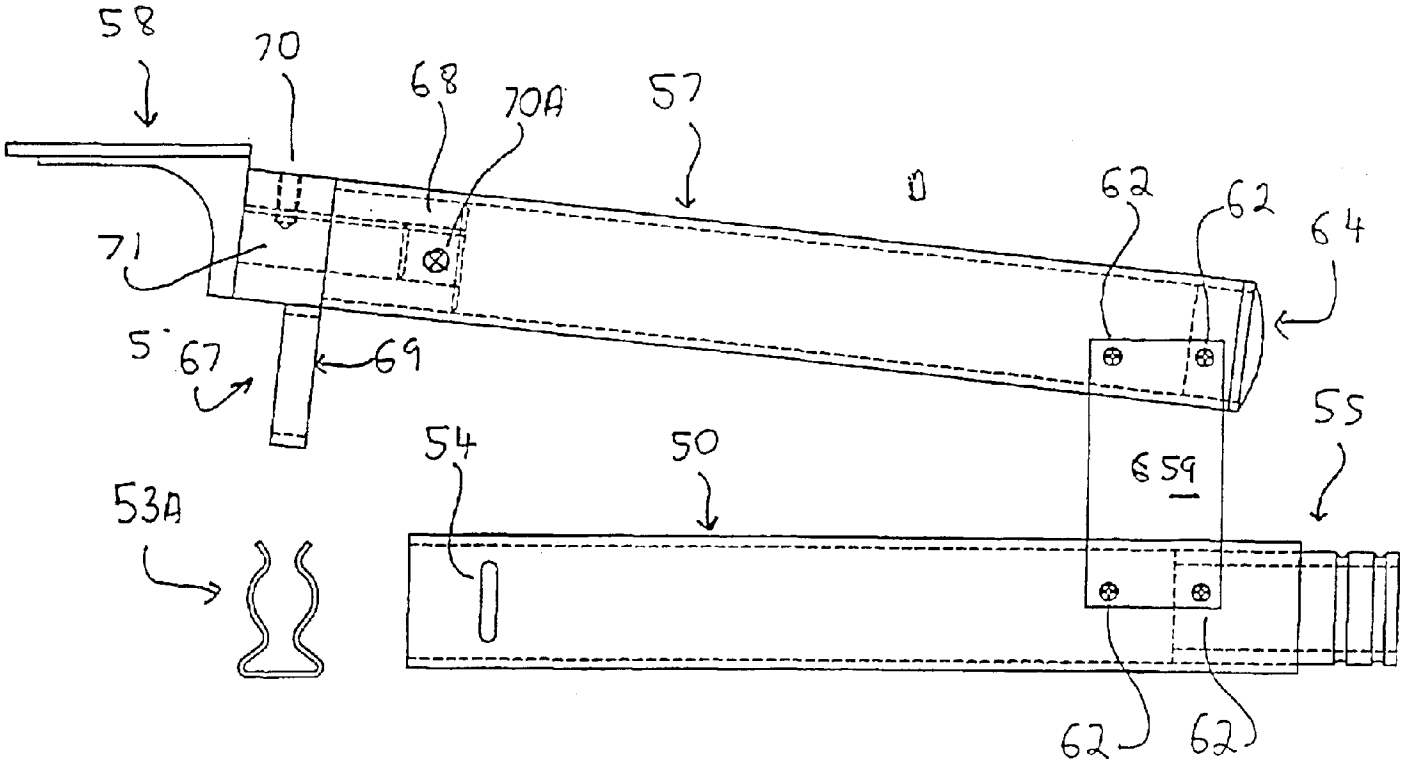
FIG. 5 is an assembled view of some of the parts of the sander of FIG. 4.

Referring to FIGS. 4 and 5, there is illustrated a slightly different version of the handle. FIG. 4 illustrates the various parts of the handle in an exploded view, and FIG. 5 Illustrates some of the parts of FIG. 4 in an assembled view.

Referring initially to FIG. 4, the handle has a first elongate cylindrical tube 50 which is similar to that described above. Tube 50 has a front end 51 and a rear end 52. Front end 51 is coupled to the exhaust outlet of the orbital sander (not illustrated but similar to that described above). In this version, the exhaust outlet collar (see FIG. 1) passes into the front end 51 of tube 50 and the two parts are held together by a clip 53 which can be as illustrated in FIG. 4, or clip 53A as illustrated in FIG. 5. The front end 51 of tube 50 is provided with two opposed slots 54 such that clip 53 can lock tube 50 against the exhaust collar. A coupling 55 fits inside the rear end 52 of tube 50. In FIG. 4, coupling 55 is shown in two pieces, while in FIG. 5 coupling 55 is a single piece. Coupling 55 is provided with annular grooves 56. An exhaust hose (not shown) can quick couple to coupling 55.

Handle has a second elongate cylindrical tube 57. Tube 57 functions to support the attachment 58 which will be described in greater detail below. Tubes 57, and 50 are coupled to each other via a block 59. Block 59 has a curved cradle portion 60 in the top of the block and the bottom of the block. These cradle portions accommodate the curved outer body of each tube 50,57. Block 59 has a through passageway 61 to accommodate the power cord of the orbital sander. Tubes 50 and 57 are fixed to block 59 via screws 62 better illustrated in FIG. 5: One end 63 of tube 57 is capped by a decorative end cap 64 which can be pressed fitted through end 63. The other end 65 of tube 57 accommodates two components. The first component is the attachment 58 and the second component is a handle adapter bracket 67. Bracket 67 has a sleeve portion 68 which fits through end 65 of tube 57. This can either be a press fit or, if necessary, a screw fastener 70A can be used to fasten bracket 67 to tube 57. Bracket 67 has a body formed with a through passageway 69. Passageway 69 extends about the handle 11 of the orbital sander (the handle illustrated in FIG. 1).

Sleeve portion 68 is hollow which allows it to accommodate a sleeve 71 of attachment 58. Thus, attachment 58 is attached to bracket 67. Screw 70 can be used to clamp the pieces together. Attachment 58 functions in a manner similar to that described with reference to FIGS. 1 and 2, and particularly functions to accommodate the extension pole if an extension pole is required.

If desired, the handle can have a guide means similar to that described above. In this embodiment, a guide means 73 Is provided on each side of tube 50. Thus, two guide means 73 can be provided although only one is illustrated in FIG. 4. Guide means 73 comprises a lower curved foot portion 74 which can be coated with a layer of Teflon. Foot portion 74 is attached to a finger 75. Finger 75 is attached to one side face 76 of block 59. A fastener 77 is used to attach fingers 75 to block 59. The guide means can be attached and removed at will.

Figure 6:
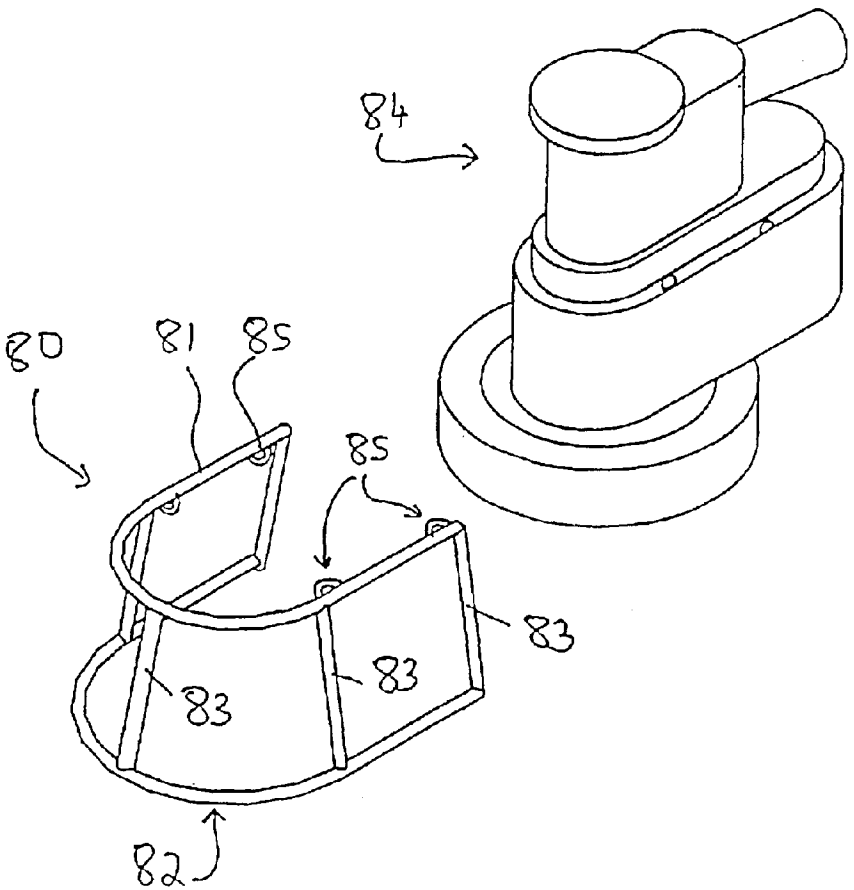
FIG. 6 illustrates a safety guard according to another embodiment of the invention.

Referring to FIG. 6 there is illustrated a safety guard 80. Safety guard 80, in the embodiment, is formed from wire or rod material and comprises upper and lower arcuate members 81, 82 which are separated and held in place by a plurality of strut members 83. Safety guard 80 can be fastened to orbital sander 84 via screw fasteners (not shown) which pass through apertures 85. Safety guard 80 functions in a manner similar to that described above to prevent damage to corners and the like.

It should be appreciated that various other changes and modifications can be made to the embodiments described without departing from the spirit and scope of the invention as claimed.

What is claimed is:

1. A detachable handle for an orbital sander of the type having a dust extractor containing an exhaust outlet, the handle comprising:

a first part in the form of an elongate member having a through passageway with two open ends, one end being removably attachable to the exhaust outlet of the sander to attach the handle to the sander and to allow dust to pass through the first passageway member, the other end being attachable to a dust discharge hose, a second part which is extendable over at least part of the top of the sander, and attachment means to allow the handle to be attached to a pole.

2. The handle of claim 1, wherein the first part and the second part comprise hollow cylindrical tubes.

3. The handle of claim 2, comprising guide means extending from a portion of the handle spaced from the sander, the guide means being adapted to contact the surface to be sanded and functioning to hold the handle relative to the surface such that, when attached to the sander, the sander is in working alignment with the surface.

4. The handle of claim 3, wherein a pair of guide means are provided, which extend from each side of the first part.

5. The handle of claim 4, wherein the guide means comprise slides.

6. The handle of claim 4, wherein the guide means comprise rollers.

7. The handle of claim 4, wherein the first part and the second part are connected relative to each other via a block.

8. The handle of claim 7, wherein the guide means are connected to the block.

9. The handle of claim 3, wherein the attachment means comprises a plate.

10. The handle of claim 1, comprising a handle adaptor bracket attached to the second part, and which is adapted to hold the handle of the sander.

11. The handle of claim 10, wherein the attachment means is attached to the bracket.

12. The handle of claim 1, where the sander has a rear handle which forms part of the top of the sander.

13. A detachable handle for an orbital sander of the type having a dust extractor containing an exhaust outlet and a rear handle, the handle comprising:

a first part in the form of an elongate member having a through passageway with two open ends, one end being removably attachable to the exhaust outlet of the sander to attach the handle to the sander and to allow dust to pass through the first passageway member, the other end being attachable to a dust discharge hose, a second part which is extendable over at least part of the rear handle of the sander, the second part being provided with a first attachment device that removably attaches the second part to the rear handle of the sander, and a second attachment device that allows the handle to be attached to a pole.

14. The handle of claim 13, wherein the second attachment device is on the second part.

* * * * *